United States Patent [19]

Cotton, Jr.

[11] Patent Number: 4,782,997

[45] Date of Patent: Nov. 8, 1988

[54] MAIL DELIVERY SIGNAL DEVICE

[76] Inventor: Thomas J. Cotton, Jr., 28091 Via Machado, Mission Viejo, Calif. 92692

[21] Appl. No.: 107,931

[22] Filed: Oct. 13, 1987

[51] Int. Cl.[4] ..... B65D 91/00

[52] U.S. Cl. ..... 232/35

[58] Field of Search ..... 232/34, 35, 17

[56] References Cited

U.S. PATENT DOCUMENTS

| | | | |
|---|---|---|---|
| 2,988,268 | 6/1961 | Mioduski | 232/35 |
| 3,143,287 | 8/1964 | Holt | 232/35 |
| 3,547,070 | 12/1970 | Schuh | 232/35 |
| 3,589,329 | 6/1971 | Schuh | 232/35 X |
| 3,650,464 | 3/1972 | Lewis | 232/35 |
| 3,722,460 | 3/1973 | James | 232/35 |
| 3,815,811 | 6/1974 | Harmon | 232/35 |
| 3,891,139 | 6/1975 | Redling | 232/35 |
| 3,960,316 | 6/1976 | Echterhag | 232/35 |
| 4,154,392 | 5/1979 | Galstad | 232/35 |
| 4,363,439 | 12/1982 | Manian | 232/35 |
| 4,382,542 | 5/1983 | Farris | 232/35 |
| 4,492,335 | 1/1985 | Davis | 232/35 |

*Primary Examiner*—Robert W. Gibson, Jr.
*Attorney, Agent, or Firm*—Weissenberger & Peterson

[57] ABSTRACT

An automatic signaling arm attachment for a standard rural mailbox with a beveled edge which can be wedged between the door and the sidewall of the mailbox to hold the signaling arm in a generally inconspicuous position alongside the mailbox when the door is closed, and which allows the arm to pivot by gravity to a highly visible position below the mailbox when the mailbox door is opened.

3 Claims, 2 Drawing Sheets

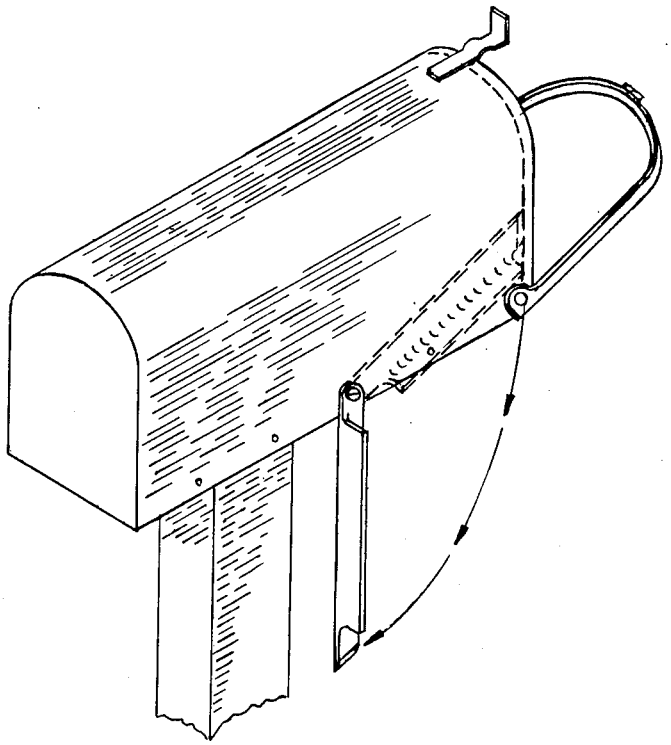

MAIL DELIVERY SIGNAL DEVICE

BACKGROUND OF THE INVENTION

1. Field of the Invention

The invention relates to a novel improvement to the standard currently used rural mailbox which has been in use for many years. Mailboxes in use by rural homeowners as well as in use by residential area homeowners do not appear to have any device on the mailbox to show the mailbox owner whether mail has been placed inside the mailbox by the mail carrier. There has been, however, more than 100 patents issued during the last 100 years relating to such a device.

2. Description of the Prior Art

Most of the prior art including the present invention involves a signaling device which is actuated by the opening of a hinged door located at the front end of the mailbox. Most of the signaling devices which have been patented comprise some sort of signal flap mounted on the surface of the hinged door or on the end opposite to the hinged door. When the door is pulled open,the flap is released and drops down by gravity thereby alerting the mailbox owner who is viewing the mailbox from a distance away that the mailbox door has been opened.

One reason why prior art patents have not enjoyed widespread use is that they all require some labor and skill to rework the existing mailbox. However, the proposed invention requires no rework of the existing standard rural mialbox. Not even the drilling of one hole is required since the signal device is mounted through an existing hole located along the lower edge of the left side of the mailbox. If even one hole is needed to be drilled for mounting of a signaling device it will be impractical for many thousands of mailbox owners who do not have a drill motor ot do not know how to use one or do not wish to hire someone to do the job. In addition, the mailbox may be located hundreds of feet away from an elecrical outlet required for operating a powered drill motor.

The patent by Ferris shows a signal device which will be relatively easy to install on an existing standard mailbox. However, the Ferris device has a flap which is attached to the surface of the hinged door by adhesive. Such an attachment by adhesive would not survive very long, especially in the changeable outdoor weather.

The Harmon device shows a signal arm mounted on the side of the mailbox and consists of three parts; a hook, a flag member and a mounting assembly. The present improvement simplifies the signal device by substituting a one piece plastic molded signal flag for the sheet metal flag member and hook elements. A further improvement over the Harmon device concerns the free end of the signal arm which is shown placed between the bent over edge of the door and the sidewall of the mailbox. Such placing of the signal arm to an existing standard rural mailbox would require considerable undesirable distortion of the bent over edge of the door in order to allow access for the signal arm free end since thousands of mailbox doors built to specifications of the United State Postal Servicce fit snugly allowing only about thirty thousands of an inch or less clearance between the bent over edge of the door and the sidewall of the mailbox. Furthermore, the mounting assembly presented in the Harmon patent would not allow the flag to rotate since the flag is shown secured to the collars which are said to be bolted to the side of the mailbox. The present improvement shows a spacer which passes through the flag member and is not secured to the flag member thereby allowing the flag to readily rotate by gravity even though the bolt or fastener is tigntened to the mailbox sidewall. In addition the Harmon patent states that the bolt which supports the mounting assembly is inserted through an opening drilled in a sidewall of the mailbox as compared to the present improvement which utilizes an existing hole.

The device by Davis which is shown mounted on the hinged door requires the mail carrier to actuate the signal flap. Paragraph 3.4 of the United States Postal Service, USPS-STD-7, states that doos other than the carrier service door shall not interfere with the normal servicing of the box by the carrier or require the carrier to perform any operation not normally used. It follows that this additional movement and thought required by the mail carrier to actuate the flap will probably not be approved by the United States Postal Service. The proposed invention will in no way require the mail carrier to actuate or reset the signaling device.

The signaling device should not interfere with the normal operation of the regular flag on the mailbox which is there to alert the mail carrier to pick up the mail. The proposed signal arm is therefore placed on the mailbox left side opposite to the right side which supports the regular flag. In addition the proposed signal arm when released to signaling position is located below the mailbox away from the regular flag which stands above the mailbox when signaling the mail carrier.

The United States Postal Servicce will not approve any flag other than the regular flag to be painted red, therefore, the proposed signal flag would be painted a high visibility flourescent color other than red so as to be easily observed from a distance.

A further improvement of this invention relates to the spacer 24 which is varied in diameter for the purpose of holding the signal arm a distance away from the side of the mailbox to help prevent snow from accumulating between the signal arm and the sidewall of the mailbox. In the event of a snowstorm the weight of the accumulated snow on the horizontal strip 21 of the signal arm will assist gravity in rotation of the signal arm to a vertical signaling position.

SUMMARY OF THE INVENTION

The invention relates to devices for signaling the presence of mail within the mailbox.

It is the object of this invention to provide an inexpensive signaling device which is easily adaptable to the existing standard rural type delivery mailbox which is specified by the United States Postal Service.

When the mailbox door is opened for insertion of the mail a rotatable arm which is located horizontally along the side of the mailbox is automatically released to a vertical position thereby signaling to the mailbox owner who is observing at a distance that the mailbox has been opened saving the time and effort required to walk out to the mailbox to see if mail has been delivered.

When the mailbox owner closes the mailbox door he or she resets the signal arm by hand to the horizontal non-signaling position.

DETAILED DESCRIPTION OF THE INVENTION

The present invention relates to a standard delivery rural type mailbox provided with a signaling device, visible from a distance, which indicates whether the mailbox has been opened for the delivery of mail. The signaling device comprises a plastic one piece signaling arm member attached along the side of the mailbox rather than on the front or rear end of the mailbox. The patent further relates to the mounting of the signal device by a fastener inserted through an already open hole in the mailbox thereby requiring zero reworking of the existing mailbox for its installation. The patent further comprises a means for holding the signal device in a generally horizontal non-signaling position by allowing gravity to hold the beveled free end of the signal arm against the bent over edge of the mailbox door.

Figure 1:
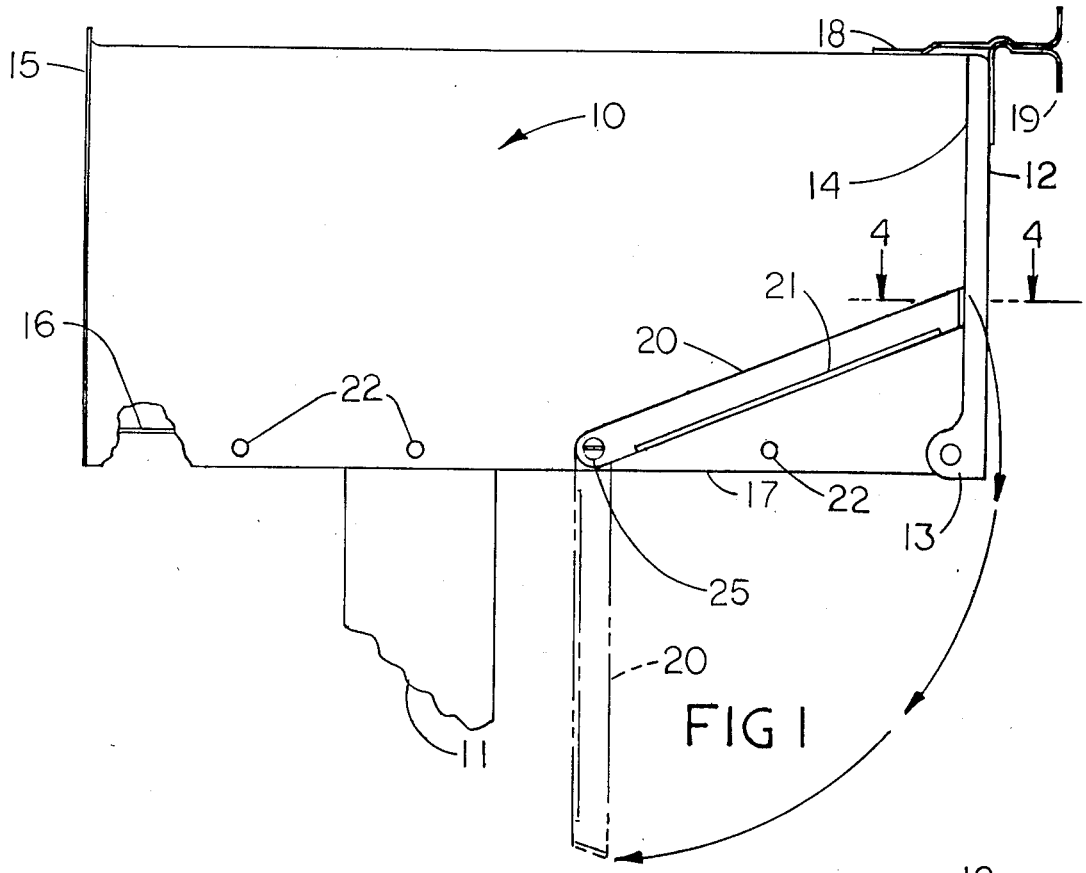
FIG. 1 is an elevation view of the standard rural delivery mailbox equipped with an automatic mail signal device with the signal arm held in substantially a horizontal non-signaling position and in dotted lines with the signal arm held in the vertical position.
Figure 2:
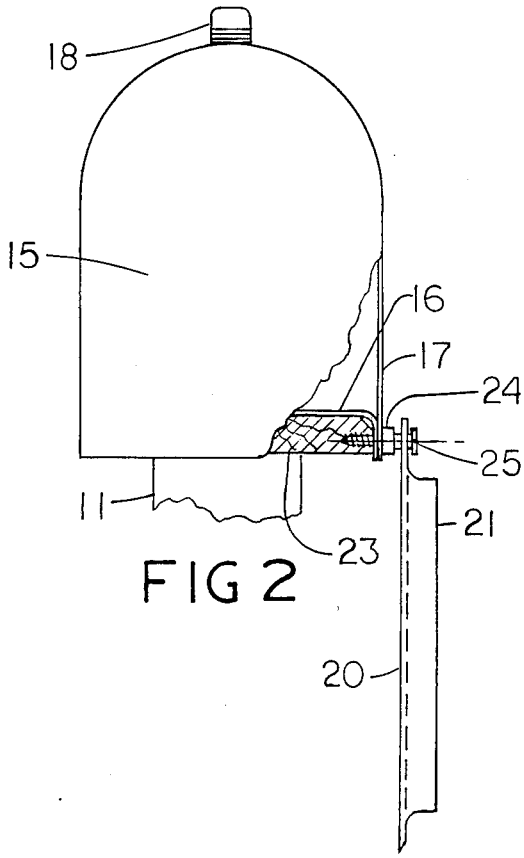
FIG. 2 is a rear view of the construction presented in FIG. 1 showing the view the mailbox owner would see from the house with the signal arm in the vertical signaling position.
Figure 3:
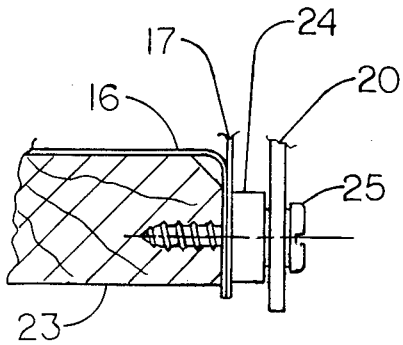
FIG. 3 is an enlarged view showing the details of the signal arm attachment to the mailbox.

Referring to the drawings in detail, FIGS. 1 to 3 show a standard rural delivery mailbox 10 which is in accordance with the United States Service Specification 7 dated October 1985. The mailbox 10 is mounted on the widely used wooden post 11 and having the usual combined sidewalls and upper curved wall 17, a fixed rearward end wall 15 and a movable front door 12 pivoted at its lower edge by hinges 13 fastened to the bottom wall 16.

The door 12 is at its top provided with a door catch 19 having a V-formation which on closing the door snaps into place with a similar box catch 18 fixed to the mailbox 10 in order to keep the door closed with the catch 19 and catch 18 being sufficiently resilient to release the door 12 by pulling the catch 19 away from the catch 18 when opening the door.

As shown in FIG. 1 a signal arm 20 is fixed to the sidewall 17 of the standard rural mailbox 10. The signal arm 20 is shown in its generally horizontal non-signaling position with one end fastened through an existing hole 27 located along the lower edge of the mailbox sidewall 17. The other end of the signal arm 20 which has a beveled or knife edge is shown held against the bent over edge of the door 12 by gravity thereby holding the signal arm in its non-signaling position. As long as the signal arm is held against the bent over edge of the door the mailbox owner who is viewing the mailbox from a distance away will know that the mail has not been delivered thereby saving the mailbox owner from making unnecessary trips to the mailbox to determine whether or not mail has been delivered.

A spacer 24 comprised of a short section of a tubular structure is shown in FIGS. 2 & 3 wherein the purpose of said spacer is to prevent the screw 25 (or bolt) from tightening down on the signal arm 20 thereby allowing the said signal arm to rotate freely by gravity from its generally horizontal non-signaling position to its vertical signaling position when the door 12 is opened thereby releasing the said signal arm.

Figure 4:
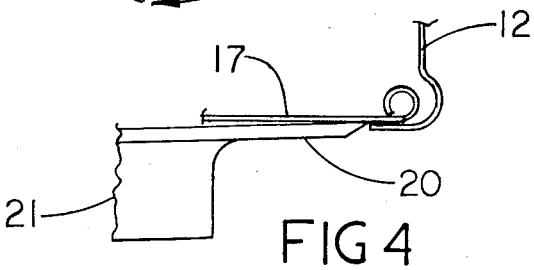
FIG. 4 is an enlarged view showing the beveled sharp edge of the signal arm wedged against the rear edge of the mailbox door.

FIG. 4 is a view showing how the sharp edge of the signal arm free end is wedged into the narrow crevice at the rear edge of the mailbox door formed by the snug fit of the bent over edge of the door against the sidewall of the mailbox when the signal arm is in the generally horizontal non-signaling position with the mailbox door closed.

Although the invention has been shown with reference to specific embodiments it will be obvious that modifications and variations may be constructed without departing from the spirit and scope of the invention. The scope of the invention is described in the following claims.

I claim:

1. An automatic signaling device for attachment to a standard rural delivery mailbox having a sidewall, said mailbox having a door at the front end, said door having a flange bent rearward a short distance over said sidewall and being mounted for pivotable movement about the bottom edge of said front end from open to closed positions with respect to said front end, comprising:

(a) an arm member; and (b) fastening means connecting said arm member and said sidewall for allowing said arm member to pivot by gravity from a position extending forwardly and upwardly adjacent said side wall to a position extending downwardly below the lower boundary of said sidewall;

(c) said arm member having a length sufficient to engage said rearwardly bent flange at a position between said forwardly and upwardly extending position and said downwardly extending position, and being of a thickness substantially greater than the distance between said sidewall and said rearwardly bent flange of said door when said door is closed, and having a front edge spaced from said fastening means which is beveled so that the surface of said arm adjacent said sidewall at said front edge is substantially flat, and that the thickness of said arm at said front edge is less than the distance between said sidewall and said rearwardly bent door flange;

(d) whereby when said door is closed and said arm member then moves downwardly from said forwardly and upwardly extending position, said beveled front edge of said arm member wedges between said sidewall and said door flange in a substantially forwardly extending position, said arm member being released to fall into said downwardly extending position when said door is opened.

2. The device of claim 1 wherein said fastening means includes a tubular shaped spacer about which said arm is free to pivot, whereby said spacer allows said fastening means to be tightened down on said spacer instead of on said arm, thereby allowing said arm to rotate freely be gravity from its generally forward position to its generally downward position when the said mailbox is opened.

3. The device of claim 1 wherein said arm is formed with an integrally mounted strip attached perpendicularly to the surface of said arm, whereby said strip provides enhanced visibility when viewed from behind said mailbox with said arm in its generally downward position.

* * * * *